United States Patent [19]

Uebelhart et al.

[11] 4,372,108

[45] Feb. 8, 1983

[54] ROTARY YARN GUIDE FOR TEXTILE MACHINES

[75] Inventors: Walter Uebelhart, Bienne; Beat Gilomen, Studen; Claude Parel, Bettlach, all of Switzerland

[73] Assignee: A. Michael S.A., Switzerland

[21] Appl. No.: 184,314

[22] Filed: Sep. 5, 1980

[30] Foreign Application Priority Data

Sep. 7, 1979 [CH] Switzerland ..... 8084/79

[51] Int. Cl.[3] ..... D01H 7/18; D01H 13/04

[52] U.S. Cl. ..... 57/358; 57/73

[58] Field of Search ..... 57/334, 341, 343–349, 57/352, 354–356, 73, 75, 358

[56] References Cited

U.S. PATENT DOCUMENTS

| | | | |
|---|---|---|---|
| 2,936,567 | 5/1960 | Russell et al. | 57/341 X |
| 3,537,250 | 4/1969 | MacKintosh | 57/341 X |
| 3,701,245 | 10/1972 | Richter | 57/343 X |
| 3,810,353 | 5/1974 | Peterson | 57/343 X |
| 3,813,869 | 6/1974 | Misaki | 57/358 |
| 3,875,734 | 4/1975 | Dupeuble | 57/342 |
| 4,135,356 | 1/1979 | Wolstencroft | 57/343 |

*Primary Examiner*—Donald Watkins

*Attorney, Agent, or Firm*—Allegretti, Newitt, Witcoff & McAndrews

[57] ABSTRACT

The rotary yarn guide for cooperating with a spindle in a textile machine comprises an externally cylindrical, hollow guide member 4 having inlet and outlet ends for guiding the yarn, a ball bearing 7 surrounding the guide member and having inner and outer races 8 and 9, the inner race being rigid with the guide member, a permanent magnet 6 for cooperating with a spindle in order to rotate the guide member, a magnet-supporting member 5 for securing the permanent magnet with the guide member, and an outer casing 13 fixed to the outer race of said ball bearing.

15 Claims, 3 Drawing Figures

ROTARY YARN GUIDE FOR TEXTILE MACHINES

BACKGROUND OF THE INVENTION

The function of a rotary yarn guide in a spinning machine is to guide the yarn along the prolongation of the axis of the spindle and to impart rotation to it in order to give it a supplementary twist. This twist ensures that the yarn will have increased strength, which reduces breakages during its production.

A rotary yarn guide comprises a guide member through which the yarn passes. This guide member is composed, in known yarn guides, of a very hard material, for example a ceramic material, in order to avoid wear or polishing of the wall of the hole through which the yarn passes. The guide member is arranged to rotate about its axis at a speed of rotation higher than that of the yarn. To this end, a ball bearing is fitted between the guide member and a support therefor and a permanent magnet is fixed to the guide member and is coupled with another magnet carried by the spindle.

The external shoulders and projections provided on the guide members of the known yarn guides make them difficult to manufacture. Grinding, which would enable very small tolerances to be achieved, is in practice generally excluded for reasons of the cost of manufacture. It was necessary therefore to accept wide tolerances in the outside diameters of the guide member and to fix other parts of the yarn guide on the said guide member, with the aid of the intermediate members such as cages, by gluing. Such fixing by gluing, however, increases the assembly time, reduces the concentricity of the component parts and makes the replacement of any one such component part, and especially the ball bearing, practically impossible.

BRIEF SUMMARY OF THE INVENTION

The invention has for its object to provide a yarn guide which does not have the drawbacks of the prior art as described above.

According to the present invention, there is provided a rotary yarn guide for a textile machine, comprising a fixed support member, an outer casing, a guide member through which the yarn is arranged to pass, a ball bearing having inner and outer races rigid with the guide member and the outer casing respectively, a permanent magnet mounted on a magnet-supporting member fixed to the said guide member so as to permit rotation to be imparted thereto and a protective cover, characterized in that the guide member has the form of a hollow cylinder with a substantially uniform outside diameters throughout its entire length.

In a first illustrative embodiment of the invention, the guide member is comprised of a straight tube composed of a hard sintered material. It is thus possible to grind the guide member at a low cost so as to obtain a specified external diameter within close tolerances.

In a second illustrative embodiment of the invention, the guide member comprises a straight tube composed of a ductile material, such as a metal alloy or a synthetic material, and two rings of a hard material fixed in the interior of the tube adjacent the extremities thereof. The tube can easily be produced to within the required tolerances by rotary machining or injection moulding.

In these two cases, other component parts can be mounted as a force fit on the guide member, thereby enabling the assembly of the yarn guide to be facilitated and making possible the easy replacement of any defective component part, especially the ball bearing. This likewise makes possible the use of ball bearings which are very small, and are therefore less expensive than those of the known yarn guides, and hence the achievement of a reduction of friction.

Moreover, in the known arrangements, the support is welded or brazed to an outer casing within which the outer race of the ball bearing is secured by an adhesive. The fixing of the yarn guide is made by screwing the support on the spinning machine while carefully adjusting the coaxiality of the guide member with respect to the spindle. The user is thus compelled to effect the same screwing and adjusting operations each time the yarn guide is changed, a periodic replacement thereof being necessary since the working life of the ball bearing is of a limited duration.

Thus further drawback is avoided by a preferred form of the yarn guide according to the invention in which the support member comprises a forked clip and the outer casing has an annular groove formed in its periphery for the reception of the arms of this clip.

The invention will now be described in more detail by way of example, with reference to the accompanying drawings, in which.

DETAILED DESCRIPTION OF THE PREFERRED EMBODIMENTS

Figure 1:
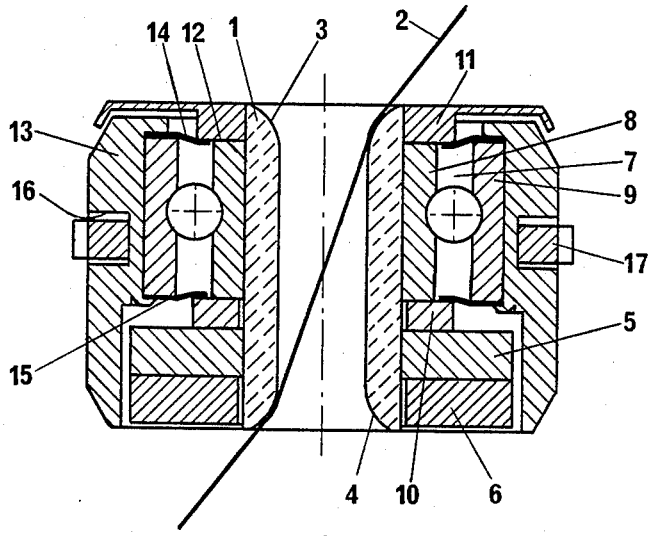
FIG. 1 is a sectional view of a yarn guide according to a first illustrative embodiment of the invention, which has a guide member in the form of a tube of hard material.
Figure 2:
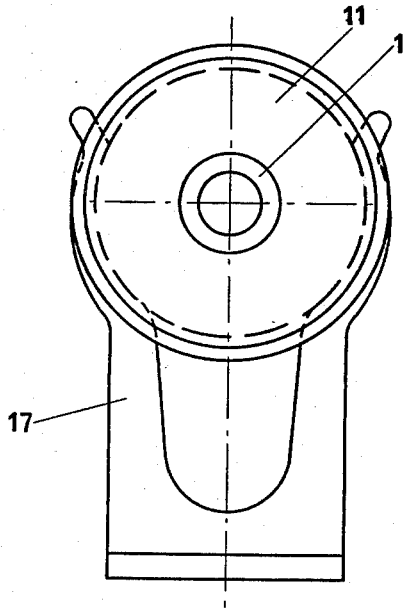
FIG. 2 is a front view of the yarn guide of FIG. 1.

The yarn guide shown in FIGS. 1 and 2 comprise a guide member 1, made in the form of a straight cylindrical tube from a hard sintered material, such as a ceramic material, through which the yarn passes. The tube, which is ground externally, has rounded end edges 3 and 4 in order to avoid damages to the yarn. An iron ring 5, which constitutes a support for a permanent magnet 6 and serves as a magnetic screen, is arranged as a force fit on the guide member 1. The permanent magnet 6 is fixed by means of an adhesive to the lower surface of the metal ring 5, in order to be able to transmit rotation to the guide member 1.

The yarn guide also comprises a ball bearing 7 which is slidably mounted on the guide member 1 and has its inner race 8 clamped between a washer 10 of non-magnetic material, which bears against the upper surface of the metal ring 5, and a boss 12 on a protective cover II which is a force fit on the guide member.

The washer 10 spaces the ball bearing 7 from the metal ring 5 in order to prevent friction between the latter, which serves as a support for the magnet 6, and the outer race 9 of the ball bearing. The mounting of the ball bearing 7 in this manner makes it possible to avoid compression of its cage, which would have occurred if the inner race of the bearing has been arranged as a force fit on the guide member and would have resulted in a reduction in the play of the balls and consequently in the life of the bearing.

The yarn guide furthermore comprises an outer casing 13, made for example of brass, which is assembled by being riveted to the outer race 9 of the ball bearing, and two foil shields 14, 15 for rendering the ball bearing dust proof. These foil shields 14, 15, in the form of thin rings, have their outer margins clamped between the outer race 9 of the ball bearing and shoulders of the outer casing 13, while their inner margins bear respectively against the boss 12 of the protective cover 11 and against the washer 10.

Furthermore, the outer casing 13 has in its periphery an annular groove 16 which serves for the reception of the two arms of a forked clip 17 which constitutes the fixed supporting member of the yarn guide.

The mounting of the yarn guide in a clip makes it possible for a defective yarn guide to be replaced rapidly and without the aid of a tool and consequently for the period of time that the spindle of the spinning machine is stopped to be reduced, thereby making the latter more economical.

Figure 3:
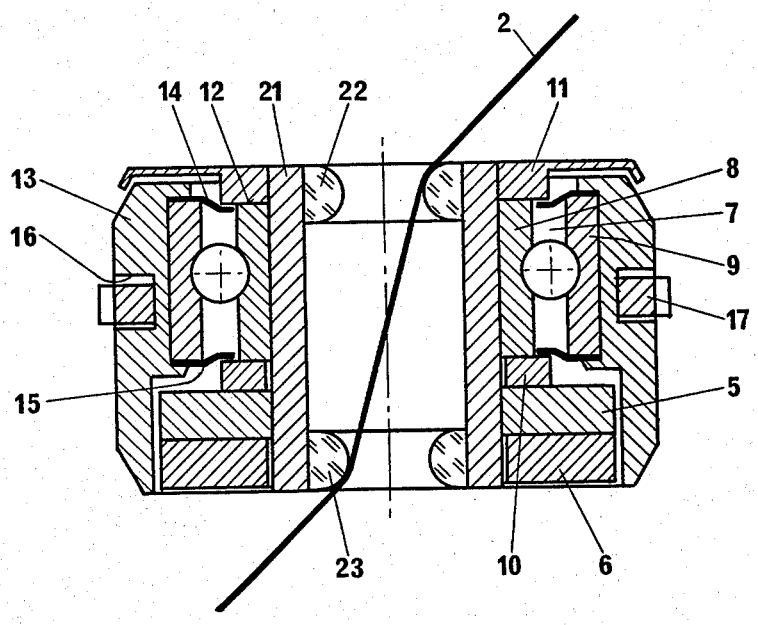
FIG. 3 is a sectional view of the yarn guide according to a second illustrative embodiment of the invention, which has a guide member in the form of a tube of ductile material, within which are fixed rings of hard material.

In the embodiment shown in FIG. 3, the guide member comprises a straight cylindrical tube 21, composed of a ductile material, and two rings 22 and 23, of a simple geometric shape, made of a hard material and engaged as a force fit in the interior of the cylindrical tube 21 adjacent the two extremities of the latter.

The other component parts of the yarn guide of FIG. 3 which are identical to those of FIG. 1 and are indicated by the same reference numerals, are assembled with respect to each other and to the guide member in the same manner as has been previously described in connection with the first embodiment.

Materials which may be used as the ductile material for the tube 21 are for example a metal alloy such as brass, steel or nickel silver, or a synthetic material such as a polycarbonate or a copolymer such as that known under the abbreviation ABS (Acrylonitrile-butadience-styrol-copolymer). The machining techniques employed in the case of a synthetic material make it possible to adhere without difficulty to the close tolerances that are necessary to enable the ring 5 which carries the magnet, the cover 11 and the rings 22, 23 to be assembled in each as a force fit on the guide member 21.

The rings 22 and 23 may be made for example of a sintered material, such as a ceramic material, or of a synthetic stone.

Although it is preferable for the ball bearing to be located by clamping its inner race, it could instead be arranged with its inner race engaged as a force fit on the guide member; the washer 10 would then no longer be necessary and the foil shields 14, 15 could be made in the form of rings, the interior diameter of which is substantially equal to the external diameter of the guide member, these rings being no longer clamped between shoulders of the outer casing 13 and the outer race of the bearing, but merely being positioned between the bearing and the protective cover 11 or the ring 5 which carries the magnet in such a manner as to bear on the one hand against the outer race of the bearing and on the outer hand against the boss 12 of the protective cover or against the magnet-carrying ring 5. It would be equally possible to fix the magnet 6 and the ring 5, which would then no longer constitute a magnetic screen, in a cage which is mounted as force fit on the guide member.

Various other modifications may be made in the form of the invention without departing from the principles disclosed in the foregoing illustrative embodiment. It is intended therefore that the accompanying claims be construed as broadly as possible consistent with the prior art.

What is claimed is:

1. A rotary yarn guide device for cooperating with a spindle in a textile machine, comprising:

an externally cylindrical, hollow guide member having inlet and outlet ends for guiding the yarn;

a ball bearing surrounding the guide member and having inner and outer races, said inner race being rigid with said guide member;

a permanent magnet for cooperating with a spindle in order to rotate said guide member;

a magnet-supporting member for securing said permanent magnet with said guide member; and an outer casing fixed to the outer race of said ball bearing.

2. A rotary yarn guide device according to claim 1 wherein said guide member is a straight tube composed of a hard sintered material.

3. A rotary yarn guide device according to claim 2 wherein said tube is made of ceramic.

4. A rotary yarn guide device according to claim 1 wherein said guide member comprises a straight tube composed of a ductile material and two rings of hard material fixed inside the tube, adjacent the inlet and outlet rods thereof.

5. A rotary yarn guide device according to claim 4 wherein said rings are mounted as a force fit within the tube.

6. A rotary yarn guide device according to claim 4 wherein said rings are made of a hard sintered material.

7. A rotary yarn guide device according to claim 4 wherein said rings are made of synthetic stone.

8. A rotary yarn guide device according to claim 4 wherein said tube is made of a metal alloy.

9. A rotary yarn guide device according to claim 4 wherein said tube is made of a synthetic material.

10. A rotary yarn guide device according to claim 1 wherein said magnet-supporting member consists of a metal ring mounted as a force fit on the guide member near the outlet end thereof and having an upper surface facing the ball bearing and a lower surface to which the permanent magnet is fixed.

11. A rotary yarn guide device according to claim 10 wherein said permanent magnet is fixed to said lower surface of the ring by means of an adhesive.

12. A rotary yarn guide device according to claim 10 further comprising a protective cover surmounting said outer casing and externally fixed to said guide member adjacent the inlet end thereof.

13. A rotary yarn guide device according to claim 12 wherein the inner race of the ball bearing is clamped between said protective cover which is mounted as a force fit on said guide member, and a washer of non magnetic material which bears upon the upper surface of said metal ring.

14. A rotary yarn guide device according to claim 1 wherein said outer race of the ball bearing is secured to the outer casing by riveting.

15. A rotary yarn guide device according to claim 1 wherein said fixed support member is a forked clip whose arms engage in an annular groove formed in the periphery of the outer casing.

* * * * *